US011540036B2

(12) United States Patent
Higgins

(10) Patent No.: US 11,540,036 B2
(45) Date of Patent: Dec. 27, 2022

(54) FLANGED EARBUD AND HEARING DEVICE INCLUDING SAME

(71) Applicant: Starkey Laboratories, Inc., Eden Prairie, MN (US)

(72) Inventor: Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 17/159,869

(22) Filed: Jan. 27, 2021

(65) Prior Publication Data

US 2021/0152913 A1 May 20, 2021

Related U.S. Application Data

(63) Continuation of application No. 16/745,572, filed on Jan. 17, 2020, now Pat. No. 10,917,711, which is a continuation of application No. 15/637,528, filed on Jun. 29, 2017, now Pat. No. 10,542,341.

(51) Int. Cl.
*H04R 1/10* (2006.01)
*H04R 25/00* (2006.01)

(52) U.S. Cl.
CPC ..... *H04R 1/1016* (2013.01); *H04R 25/60* (2013.01); *H04R 25/652* (2013.01); *H04R 2460/09* (2013.01); *H04R 2460/11* (2013.01)

(58) Field of Classification Search
CPC ..... H04R 25/652; H04R 25/654; H04R 2225/77; H04R 2460/09; H04R 2460/11
See application file for complete search history.

(56) References Cited

U.S. PATENT DOCUMENTS 2,430,229 A 11/1947 Kelsey
4,055,233 A * 10/1977 Huntress ..... H04R 1/1016 181/135
7,027,608 B2 * 4/2006 Fretz ..... H04R 25/656 381/330
7,113,611 B2 * 9/2006 Leedom ..... H04R 25/65 381/322
8,031,900 B2 * 10/2011 Dyer ..... H04R 1/1016 381/380

(Continued)

FOREIGN PATENT DOCUMENTS

WO 2011/076246 6/2011
WO 2012/149970 11/2012

*Primary Examiner* — Ryan Robinson
(74) *Attorney, Agent, or Firm* — Mueting Raasch Group

(57) ABSTRACT

Various embodiments of an earbud for insertion into an ear canal and a hearing device that includes such earbud are disclosed. The earbud includes an elongated body having a first end, a second end, and a cavity that extends along a body axis between the first end and the second end of the elongated body. The earbud also includes a first flange connected to the elongated body, where the first flange includes a first end adjacent the first end of the elongated body, a second end, and a sound hole disposed in the first end of the first flange that is acoustically connected to the cavity of the elongated body. The first flange further includes a vent disposed through the first flange. The earbud also includes a second flange connected to the second end of the elongated body and including a first end adjacent the second end of the elongated body and a second end.

20 Claims, 5 Drawing Sheets

(56) References Cited

U.S. PATENT DOCUMENTS

| | | | | |
|---|---|---|---|---|
| 8,111,853 | B2 | 2/2012 | Isvan | |
| 8,184,839 | B2 | 5/2012 | Gudmundsen et al. | |
| 8,201,561 | B2 * | 6/2012 | Blanchard | A61F 11/08 128/864 |
| 8,297,287 | B2 * | 10/2012 | Falco | A61F 11/08 128/864 |
| 8,923,543 | B2 | 12/2014 | Sacha et al. | |
| 9,088,846 | B2 * | 7/2015 | Blanchard | A61F 11/08 |
| 9,479,859 | B2 | 10/2016 | Henry et al. | |
| 9,479,878 | B2 | 10/2016 | Higgins et al. | |
| 9,485,595 | B2 | 11/2016 | Trine et al. | |
| 9,584,895 | B2 * | 2/2017 | Blanchard | H04R 1/1016 |
| 9,807,524 | B2 * | 10/2017 | Shennib | H04R 25/652 |
| 2003/0081794 | A1 * | 5/2003 | Fushimi | H04R 1/1016 381/74 |
| 2010/0166241 | A1 | 7/2010 | Sabio | |
| 2012/0257774 | A1 * | 10/2012 | Larsen | H04R 25/656 381/328 |
| 2016/0057551 | A1 * | 2/2016 | Higgins | H04R 31/00 381/328 |

* cited by examiner

FLANGED EARBUD AND HEARING DEVICE INCLUDING SAME

RELATED PATENT DOCUMENTS

This application is a continuation of U.S. application Ser. No. 16/745,572, filed Jan. 17, 2020, which is a continuation of U.S. application Ser. No. 15/637,528 filed on Jun. 29, 2017, now U.S. Pat. No. 10,542,341, which is incorporated herein by reference in its entirety.

BACKGROUND

Hearing devices such as smart phones and hearing aids typically include an earbud that is adapted to be adjacent to or inserted into an ear canal of a user. Such earbuds typically include one of two different types of configurations. The first configuration is an open design where acoustic information from the hearing device can be directed into the ear canal of a user along with ambient sound from the user's environment. For earbuds that are at least partially inserted into the ear canal, one or more vents may be formed in the earbud that allow the ambient sound to be transmitted from the user's environment into the ear canal and received by the user. The second configuration is an occluded design that also delivers acoustic information from the hearing device into the ear canal of the user while substantially or completely sealing the ear canal such that most or all ambient sound from the user's environment does not reach the ear canal.

Hearing aids that include one or more of these earbuds are electroacoustic devices that amplify sound for the user to correct hearing deficits as measured by audiometry, usually with the primary purpose of making speech more intelligible. Certain types of hearing aids utilize the earbud that is placed in the user's ear canal that conducts the sound produced by the hearing aid's receiver (i.e., loudspeaker). A receiver-in-canal (RIC) hearing aid has a small body that sits behind the ear and houses the hearing aid's microphone and audio processing circuitry. The receiver of the RIC hearing aid is attached to the earbud inside the ear and is connected to the body of the hearing aid by a slim tube that houses the receiver wiring. Other types of hearing aids may incorporate the receiver into the body behind the ear that then conducts sound to an earbud inside the ear via an audio tube.

SUMMARY

In general, the present disclosure provides various embodiments of an earbud and a hearing device that includes such earbud. In one or more embodiments, the earbud can include a first flange and a second flange. The first flange, which is adapted to be inserted into an ear canal of a user before the second flange is inserted, can include one or more vents such that the first flange provides an open style earbud that allows ambient sound to be transmitted to the user. Further, in one or more embodiments, the second flange, which is adapted to be inserted into the ear canal of the user after the first flange is inserted, can be a continuous flange that provides an occluded style earbud. In one or more embodiments, the first flange can provide acoustic transparency to the user by allowing transmission of ambient sound while retaining the earbud in the user's ear canal, and the second flange when inserted into such ear canal can occlude the canal to block transmission of at least a portion of the ambient sound to the user.

In one aspect, the present disclosure provides an earbud for insertion into an ear canal. The earbud includes an elongated body having a first end, a second end, and a cavity that extends along a body axis between the first end and the second end of the elongated body. The earbud also includes a first flange connected to the elongated body, where the first flange includes a first end adjacent the first end of the elongated body, a second end, and a sound hole disposed in the first end of the first flange that is acoustically connected to the cavity of the elongated body. The first flange further includes a vent disposed through the first flange. The earbud also includes a second flange connected to the second end of the elongated body and includes a first end adjacent the second end of the elongated body and a second end.

In another aspect, the present disclosure provides a hearing device that includes a housing having a sound port, hearing assistance components disposed within the housing, and an earbud connected to the housing and adapted to be inserted into an ear canal. The earbud includes an elongated body having a first end, a second end, and a cavity that extends along a body axis between the first end and the second end of the elongated body, where the cavity is acoustically connected to the sound port of the housing. The earbud further includes a first flange connected to the elongated body, where the first flange includes a first end adjacent the first end of the elongated body, a second end, and a sound hole disposed in the first end of the first flange that is acoustically connected to the cavity of the elongated body. The first flange further includes a vent disposed through the first flange. The earbud also includes a second flange connected to the second end of the elongated body, where the second flange includes a first end adjacent the second end of the elongated body and a second end.

All headings provided herein are for the convenience of the reader and should not be used to limit the meaning of any text that follows the heading, unless so specified.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of and" comprises at least one of followed by a list refers to any one of the items in the list and any combination of two or more items in the list.

The phrases "at least one of and" comprises at least one of followed by a list refers to any one of the items in the list and any combination of two or more items in the list.

As used herein, the term "or" is generally employed in its usual sense including "and/or" unless the content clearly dictates otherwise.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
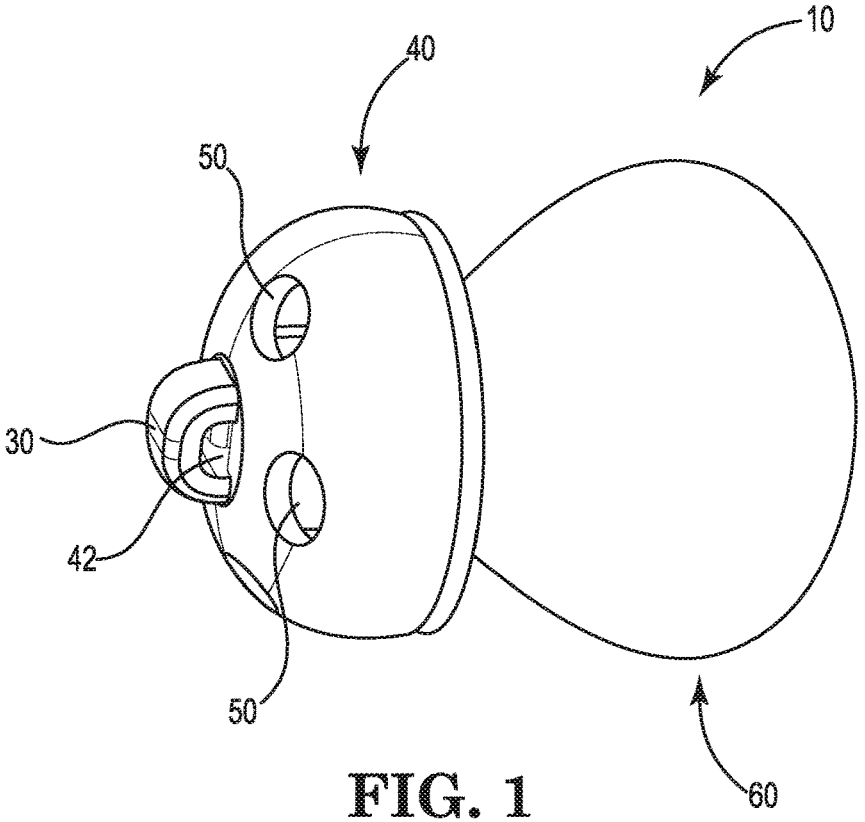
FIG. 1 is a schematic perspective view of one embodiment of an earbud.

In general, the present disclosure provides various embodiments of an earbud and a hearing device that includes such earbud. In one or more embodiments, the earbud can include a first flange and a second flange. The first flange, which is adapted to be inserted into an ear canal of a user before the second flange is inserted, can include one or more vents such that the first flange provides an open style earbud that allows ambient sound to be transmitted to the user. Further, in one or more embodiments, the second flange, which is adapted to be inserted into the ear canal of the user after the first flange is inserted, can be a continuous flange that provides an occluded style earbud. In other words, the second flange can create an acoustic seal against sidewalls of the ear canal or at an aperture of the ear canal, resulting in a sealed enclosure, which may provide an improved bass response in the ear canal. Once inserted into the ear canal, the user can manipulate the earbud between a first position, where only the first open-style flange is inserted into the ear canal, and a second position, where both the first and second flanges are inserted into the ear canal, thereby providing an occluded style earbud.

Some current designs of earbuds are configured to be either open or occluded. To alternate between an open and an occluded design, the earbud has to be removed, and an ear tip of the earbud manually replaced with the desired earbud design. Further, some current earbuds include a mechanical valve that is manipulated between an open and occluded design either mechanically or electrically to open or close a vent that allows ambient acoustical information to enter the ear canal.

Various embodiments of earbuds described herein can provide one or more advantages over these current designs. For example, one or more embodiments of earbuds described herein can provide both open and occluded designs or functions, where the user can manipulate the depth of insertion of the earbud into an ear canal of the user to selected the desired design. As a result, such embodiments do not require removal of the earbud from the ear canal to switch ear tips of the earbud or mechanical valves to open and close one or more events in the earbud. For example, in one exemplary embodiment, the earbud includes an open-style front flange and an occluded-style rear flange. This open-style front flange can allow ambient sound to reach the eardrum of the user while retaining the earbud within the ear canal. By increasing the depth of insertion of the earbud, the second or rear flange can provide an acoustic seal against the sidewalls of the ear canal, thereby forming a sealed enclosure that can provide an improved base response within the canal while blocking substantially all of the ambient sound from reaching the ear canal. To switch between the open position and the occluded position, the user increases or decreases the depth of insertion of the earbud into the ear canal.

The various earbuds described herein can be utilized with any suitable hearing device. As used herein, the term "hearing device" means a device for providing audio-related content to a user. The hearing device can include any suitable device for providing this audio-related content, e.g., a smartphone, radio, personal music player, hearing assistance device (e.g., hearing aid), etc. In one or more embodiments, the hearing device can include a consumer electronic wearable audio device having various functionalities. In one or more embodiments, the hearing device may assist or augment the auditory environment of the user or otherwise provide audio content to the user. The hearing device may provide a processed version of the audio content heard by the user to enhance the auditory experience of the user (e.g., compensating for a hearing impairment). For example, the hearing device may provide audio content to the user based on data received from another device or system, locally or other the internet, by the hearing device (e.g., a direct or composite room microphone feed, a videoconference audio stream, a teleconference audio stream, background music, or advertising). The hearing device may have one or more settings that can be changed based on one or more hearing program parameters.

A hearing device may include hearing assistance devices, or hearing aids of various types, such as behind-the-ear (BTE), in-the-ear (ITE), in-the-canal (ITC), receiver-in-canal (RIC), or completely-in-the-canal (CIC) type hearing aids. It is understood that BTE type hearing aids may include devices that reside substantially behind the ear or over the ear. Such devices may include hearing aids with receivers associated with the electronics portion of the device, or hearing aids of the type having receivers in the ear canal of the user, including but not limited to receiver-in-canal (MC) or receiver-in-the-ear (RITE) designs. The present subject matter can also be used in hearing assistance devices generally, such as cochlear implant type hearing devices and deep insertion devices having a transducer, such as a receiver or microphone, whether custom fitted, standard, open fitted, or occlusive fitted. It is understood that other devices not expressly stated herein may also be used with the present subject matter.

In one or more embodiments, the hearing assistance device can include one or more of the following: an input transducer for converting an audio input into an input signal; a digital signal processor (DSP) for processing the input signal into an output signal in a manner that compensates for a user's hearing deficit; an audio amplifier and receiver for converting the output signal into an audio output; and an earbud as described herein attached to the receiver.

Hearing assistance devices typically include an enclosure or housing, a microphone, hearing assistance device electronics or components, including processing electronics, and a speaker or receiver. It is understood that in various embodiments the microphone is optional. Further, it is understood that in various embodiments the receiver is optional. Such devices may include antenna configurations, which may vary and may be included within an enclosure for the electronics or be external to an enclosure for the electronics. Thus, the various embodiments described herein are intended to be demonstrative and not a limiting or exhaustive depiction of variations.

It is further understood that any hearing device may be used without departing from the scope, and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is further understood that digital hearing aids include a processor. In digital hearing aids with a processor programmed to provide corrections to hearing impairments, programmable gains are employed to tailor the hearing aid output to a user's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

FIGS. 1-5 are various views of one embodiment of an earbud 10. The earbud 10 can be adapted for insertion into an ear canal. The earbud 10 includes an elongated body 20 having a first end 22, a second end 24, and a cavity 26 that extends along a body axis 2 between the first end and the second end of the elongated body. The earbud 10 also includes a first flange 40 connected to the elongated body 20. The first flange 40 includes a first end 44 adjacent the first end 22 of the elongated body 20, a second end 48, and a sound hole 42 disposed in the first end 44 of the first flange that is acoustically connected to the cavity 26 of the elongated body 20. The first flange 40 also includes a vent 50 disposed through the first flange. Further, the earbud 10 also includes a second flange 60 connected to the second end 24 of the elongated body 20. The second flange 60 includes a first end 64 adjacent the second end 24 of the elongated body and a second end 68.

The elongated body 20 can include any suitable material or materials, e.g., polymeric, inorganic, and metallic materials. In one or more embodiments, the materials of the elongated body 20 can include any suitable thermoplastic elastomers, thermoplastic polyurethanes, synthetic rubbers, silicones, and combinations thereof.

Further, the elongated body 20 can take any suitable shape or shapes. In one or more embodiments, the elongated body 20 includes a cylindrical shape in a plane that is orthogonal to the body axis 2. The elongated body 20 can also have any suitable dimensions. The elongated body 20 can have a cross-sectional area in the plane orthogonal to the body axis 2 that is constant between the first end 22 and the second end 24 of the body. In one or more embodiments, the cross-sectional area of the elongated body 20 can vary between the first end 22 and the second and 24, e.g., elongated body can have a tapered shape.

The elongated body 20 can also include the cavity 26 disposed within the body. The cavity 26 can extend along the body axis 2 between the first end 22 and the second end 24 of the elongated body. The cavity 26 can have any suitable dimensions and can take any suitable shape or shapes. In one or more embodiments, the cavity 26 can be adapted to receive a housing (e.g. housing 110 of FIG. 7). The cavity 26 can have a shape in the plane orthogonal to the body axis 2 that is constant between the first end 22 and the second and 24 of the elongated body. In one or more embodiments, the cross-sectional shape or area of the cavity 26 can vary along the body axis 2 between the first end 22 and the second end 24 of the elongated body. Further, in one or more embodiments, the cavity 26 can include one or more ribs 28 that are adapted to engage one or more retainer rings of a housing such that the housing is retained within the earbud 10 as is further described herein.

The elongated body 20 can also include an acoustic port 32 disposed in the first end 22 of the body. The acoustic port 32 is acoustically connected to the cavity 26 of the body 20 and can be adapted to direct sound produced by a hearing device that is acoustically connected to the cavity 26 of the body to the user. The acoustic port 32 can take any suitable shape or shapes and have any suitable dimensions.

Connected to the elongated body 20 is the first flange 40. The first flange 40 includes the first end 44 adjacent the first end 22 of the elongated body 20, the second end 48, and the sound hole 42 that is disposed in the first end 44 of the first flange. The first flange 40 can be connected to the elongated body 20 in any suitable location along the body. In one or more embodiments, the first flange 40 is connected to the elongated body 20 such that the first end 44 is adjacent the first end 22 of the elongated body. As used herein, the phrase "adjacent the first end" means that the first end 44 of the first flange 40 is connected to the elongated body 20 such that it is closer to the first end 22 of the elongated body than to the second end 24 of the body. The sound hole 42 is acoustically connected to the cavity 26 of the elongated body 20. In one or more embodiments, the sound hole 42 of the first flange 40 is in registration with the acoustic port 32 of the elongated body 20 such that sound that is directed into the cavity 26 of the elongated body 20 can further be directed through the acoustic port 32 and the sound hole 42 and received by the user.

The first flange 40 can include any suitable material or materials, e.g. foams, thermoplastic elastomers, thermoplastic polyurethanes, synthetic rubbers, silicones, and combinations thereof. In one or more embodiments, the first flange 40 includes the same material or materials as those utilized to form the elongated body 20. In one or more embodiments, the first flange 40 is formed of a material or materials that are different from the materials utilized to form the elongated body 20. Further, in one or more embodiments, the first flange 40 can be integral with the elongated body 20, i.e., the first flange and the elongated body can be formed to provide a single, unitary part or element.

Figure 2:
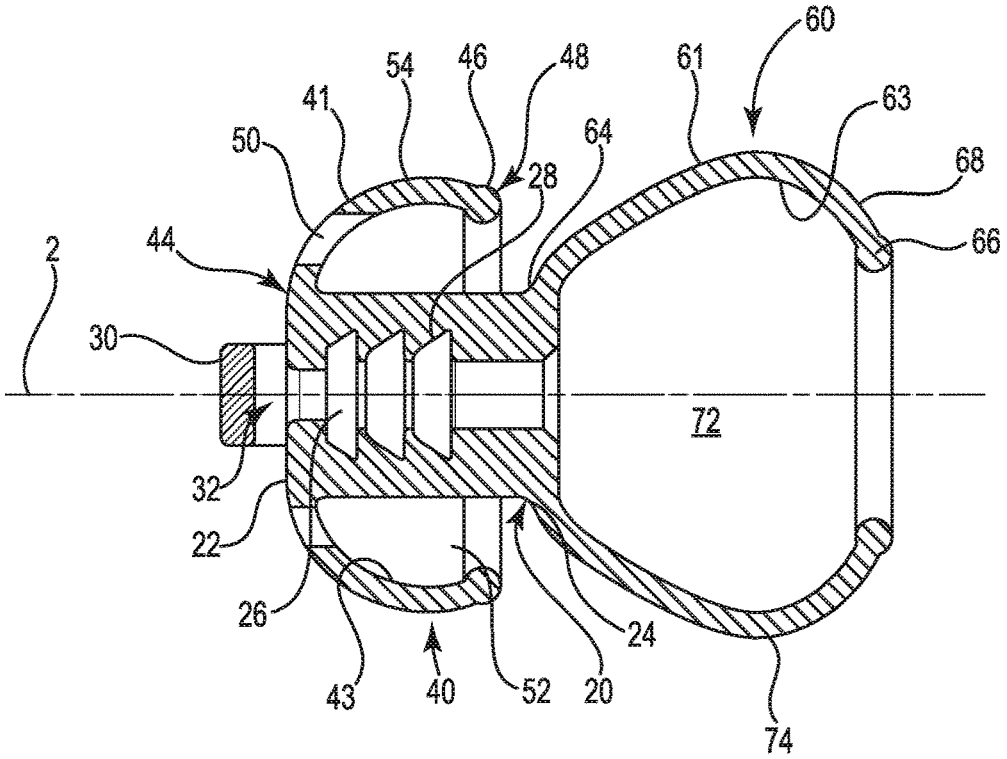
FIG. 2 is a schematic cross-section view of the earbud of FIG. 1.
Figure 3:
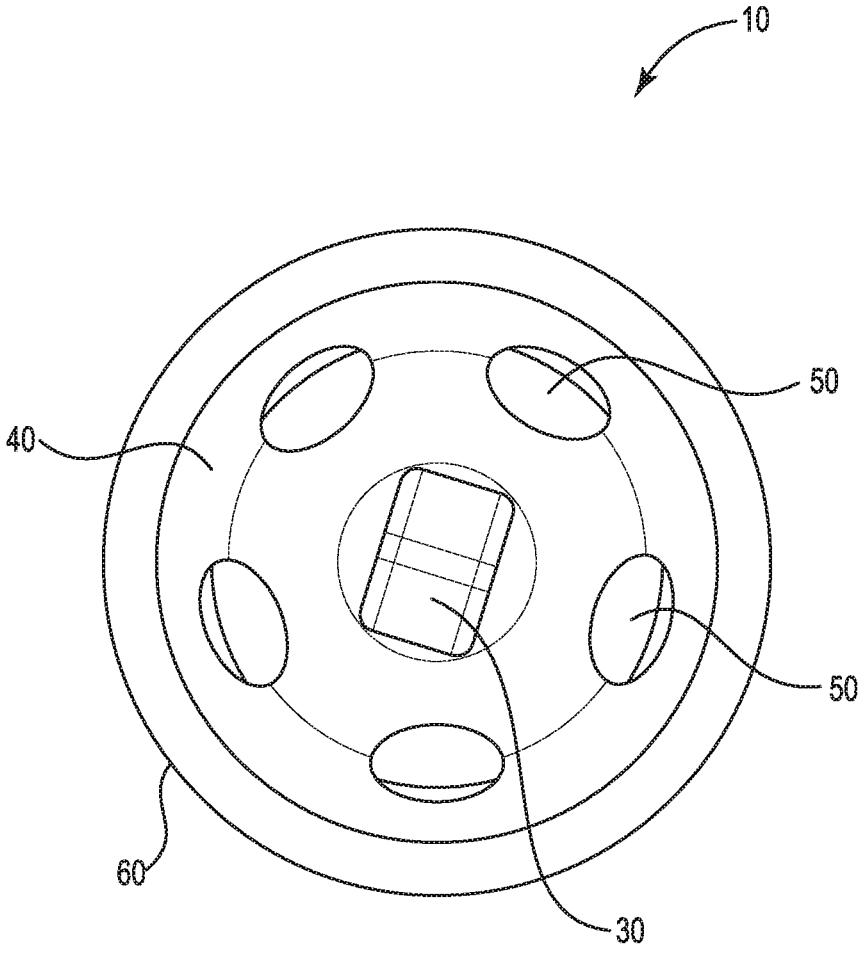
FIG. 3 is a schematic end view of the earbud of FIG. 1.

The first flange 40 can take any suitable shape or combination of shapes. As illustrated in FIGS. 1-3, the first flange 40 extends radially and distally from the first end 22 of the elongated body 20 and terminates at a retainer ring 46 at the second end 48 of the flange and adjacent the second end 24 of the elongated body. As used herein, the phrase "adjacent the second end" means that the retainer ring 46 is disposed closer to the second end 24 of the elongated body 20 than to the first end 22 of the body.

In one or more embodiments, the first flange 40 can take a shape such that a circumference of the flange measured in a plane orthogonal to the body axis 2 increases in a direction from the first end 44 to the second end 48 of the first flange. In one or more embodiments, the circumference of the first flange 40 increases in a direction from the first end 44 to a maximum value at an apex 54 of the first flange and then decreases to the circumference of the retainer ring 46. In one or more embodiments, a longitudinal distance from the apex 54 of the first flange 40 to the retainer ring 46 is less than the longitudinal distance from the apex of the first flange to the first end 44 of the first flange. Further, in one or more embodiments, a rate at which the circumference of the first flange 40 decreases to the longitudinal distance from the apex 54 of the flange to the retainer ring 46 may be greater than the rate at which the circumference of the first flange increases with respect to longitudinal distance from the first end 44 to the apex of the first flange.

The extension of the first flange 40 past its apex 54 in the direction from the first end 44 to the second end 48 can create a balloon effect, and the retainer ring 46 can prevent warping and puckering when the first flange is deflected to maintain a circular or elliptical cross-section of the first flange. Over time, areas of puckering in the earbud 10 may create sore spots in the ear canal that can reduce comfort. Excess radial pressure can cause the first flange 40 to extrude distally along the body axis 2 while maintaining a radial seal against the ear canal. The first flange 40 can include a resilient material or materials that allow the first flange to return to its original shape when no longer under a compressive force.

As stated herein, the first flange 40 can take any suitable shape or shapes. In one or more embodiments, the first flange 40 can have a circular or elliptical cross-section in the plane orthogonal to the body axis 2. Further, the first flange 40 can include a cavity 52 disposed between an inner surface 43 of the first flange and the body 20 such that at least a portion of the first flange can collapse towards the body axis 2 when the first flange 40 is inserted into the ear canal. The cavity 52 can take any suitable shape or shapes and have any suitable dimensions. In one or more embodiments, the first flange 40 can have a constant thickness. In one or more embodiments, one or more portions of the first flange 40 can have a thickness that is different from the thickness of one or more additional portions of the first flange.

The first flange 40 can also include an optional wax bridge 30 disposed on an outer surface 41 of the first flange along the body axis 2 and over the sound hole 42 of the first flange. The wax bridge 30 can prevent direct line-of-sight wax ingress into the cavity 26 of the elongated body 20. The wax bridge 30 can be connected to the first flange 40 using any suitable technique or techniques. In one or more embodiments, the wax bridge 30 is integral with the first flange 40.

The first flange 40 includes one or more vents 50 disposed through the first flange. In one or more embodiments, the one or more vents 50 can extend between the outer surface 41 and the inner surface 43 of the first flange 40. Further, each vent 50 can take any suitable shape or shapes and have any suitable dimensions. In one or more embodiments, one or more vents 50 can include a circular shape. Each vent 50 can take the same shape. In one or more embodiments, one or more vents 50 can take a shape that is different from one or more additional vents. Although depicted as including four vents 50, the first flange 40 can include any suitable number of vents. Further, in one or more embodiments, the first flange 40 does not include any vents such that the flange extends continuously from the sound hole 42 to the retainer ring 46. Embodiments of the first flange 40 that include one or more vents 50 can be considered an open design or configuration, and embodiments of the first flange the do not include vents can be considered an occluded design or configuration. For the open design, the vents 50 of the first flange 40 can allow ambient sound to enter the ear canal of the user such that the user can hear such ambient sound. As a result, the open design can provide the user with acoustical information from the user's environment.

The first flange 40 can also include the retainer ring 46, which can be connected to the first flange using any suitable technique or techniques. In one or more embodiments, the retainer ring 46 is integral with the first flange 40. Further, the retainer ring 46 can take any suitable shape or shapes and have any suitable dimensions. In one or more embodiments, a cross-sectional thickness of the retainer ring 46 can be greater than a cross-sectional thickness of the first flange 40. In one or more embodiments, the cross-sectional thickness of the retainer ring 46 can be less than the cross-sectional thickness of the first flange 40.

The earbud 10 can also include the second flange 60 that is connected to the elongated body 20 between the first flange 40 and the second end 24 of the elongated body. The second flange 60 includes the first end 64 and the second end 68. The first end 64 of the second flange 60 can be disposed adjacent the second end 24 of the elongated body 20. The second flange 60 can be connected to the elongated body 20 using any suitable technique or techniques. In one or more embodiments, the second flange 60 is integral with the elongated body 20. In one or more embodiments, both the first flange 40 and the second flange 60 are integral with the elongated body 20.

The second flange 60 can include any suitable material or materials, e.g., the same materials described herein regarding one or both of the elongated body 20 and the first flange 40. In one or more embodiments, the second flange 60 includes the same material or materials as those utilized to form the first flange 40. In one or more embodiments, the second flange 60 is formed of a material or materials that are different from the materials utilized to form the first flange 40.

The second flange 60 can take any suitable shape or shapes. As illustrated in FIGS. 1-5, the second flange 60 extends radially and distally from adjacent the second end 24 of the elongated body 20 and terminates in a retainer ring 66. As used herein, the phrase "adjacent the second end" means that the second flange 60 is disposed closer to the second end 24 of the elongated body than to the first end 22 of the body. The retainer ring 66 can be connected to the second flange 60 using any suitable technique or techniques. In one or more embodiments, the retainer ring 66 is integral with the second flange 60. Further, the retainer ring 66 can take any suitable shape or shapes and have any suitable dimensions. In one or more embodiments, a cross-sectional thickness of the retainer ring 66 can be greater than a cross-sectional thickness of the second flange 60. In one or more embodiments, the cross-sectional thickness of the retainer ring 66 can be less than the cross-sectional thickness of the second flange 60. The second end 68 of the second flange 60 includes the retainer ring 66.

As stated herein, the second flange 60 can take any suitable shape or shapes. In one or more embodiments, the second flange 60 can take a shape that is the same as a shape or shapes of the first flange 40. In one or more embodiments, the second flange 60 can take a shape that is different from the shape of the first flange 40.

In one or more embodiments, the second flange 60 can have a circular or elliptical cross-section in a plane orthogonal to the body axis 2. Further, the second flange 60 can include a cavity 72 disposed between an inner surface 63 of the second flange and the body 20 such that at least a portion of the second flange can collapse towards the body axis 2 when the second flange is inserted into the ear canal. The cavity 72 can take any suitable shape or shapes and have any suitable dimensions. In one or more embodiments, the second flange 60 can have a constant thickness. In one or more embodiments, one or more portions of the second flange 60 can have a thickness that is different from a thickness of one or more additional portions of the second flange.

As mentioned herein, the second flange 60 can have any suitable dimensions. Further, the second flange 60 can have any suitable dimensions relative to the first flange 40. For example, the first flange 40 can have a maximum circumference as measured in a plane orthogonal to the body axis 2, and the second flange 60 can have a maximum circumference measured in the plane orthogonal to the body axis. In one or more embodiments, the maximum circumference of the first flange 40 is equal to the maximum circumference of the second flange 60. In one or more embodiments, the maximum circumference of the first flange 40 is less than the maximum circumference of the second flange 60 as is shown in FIG. 3. Further, in one or more embodiments, the maximum circumference of the first flange 40 is greater than the maximum circumference of the second flange 60.

In one or more embodiments, the second flange 60 can take a shape such that the circumference of the second flange measured in a plane orthogonal to the body axis 2 increases in a direction from the first end 64 to the second end 68 of the second flange. In one or more embodiments, the circumference of the second flange 60 increases in a direction from the first end 64 to a maximum value at an apex 74 and then decreases to the circumference of the retainer ring 66. In one or more embodiments, a longitudinal distance from the apex 74 of the second flange 60 to the retainer ring 66 is less than the longitudinal distance from the apex of the second flange to the first end 64 of the second flange. Further, in one or more embodiments, a rate at which the circumference of the second flange 60 decreases to the longitudinal distance from the apex 74 of the second flange to the retainer ring 66 may be greater than the rate at which the circumference of the second flange increases with respect to longitudinal distance from the first end 64 to the apex of the second flange.

As with the first flange 40, the extension of the second flange 60 past its apex 74 in the direction from the first end 64 can create a balloon effect, and the retainer ring 66 can prevent warping and puckering when the second flange is deflected to maintain a circular or oval cross-section. Overtime, areas of puckering in the earbud 10 may create sore spots in the ear canal that can reduce comfort. Excess radial pressure can cause the second flange 60 to extrude distally along the body axis 2 while maintaining a radial seal against the ear canal. In one or more embodiments, the second flange 60 can include one or more resilient materials such that the second flange will return to its original shape when no longer under a compressive force.

The body 20, the first flange 40, and the second flange 60 can be manufactured using any suitable technique or techniques. For example, at least one of the body 20, first flange 40, and second flange 60 can be manufactured utilizing, e.g., injection molding, cast molding, transfer molding, 3D printing, etc. In one or more embodiments, the body 20, first flange 40, and second flange 60 can be manufactured separately and then connected together using any suitable technique or techniques, adhering, welding, ultrasonic welding, etc. In one or more embodiments, the body 20 and at least one of the first flange 40 and second flange 60 can be integral.

In one or more embodiments, at least one of the body 20, first flange 40, and second flange 60 can be manufactured using a single-shot molding process where the material thicknesses of the body, first flange, and second flange, are made utilizing different materials such that the resulting earbud has differing degrees of resilience or stiffness amongst the components. In one or more embodiments, a two-shot or multiple-shot molding process can be utilized such that the body 20 is made from a material that is more stiff than the material of one or both of the first flange 40 and the second flange 60. Use of a stiffer material for the body 20 can allow it to be constructed with a thinner wall section.

Figure 4:
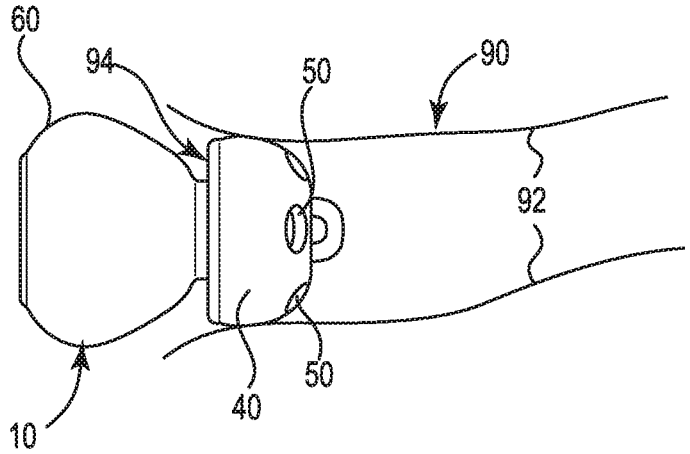
FIG. 4 is a schematic cross-section view of the earbud of FIG. 1 in a first position relative to an ear canal of a user.
Figure 5:
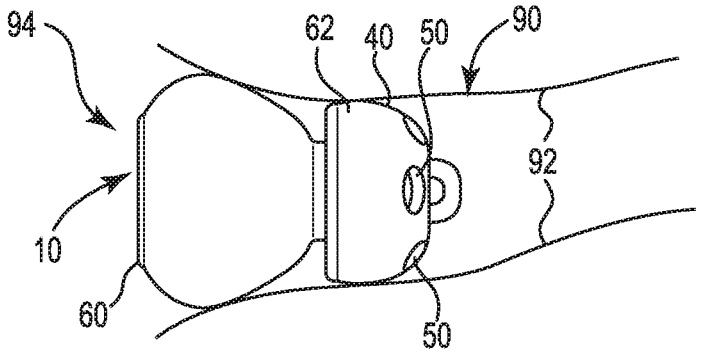
FIG. 5 is a schematic cross-section view of the earbud of FIG. 1 in a second position relative to the ear canal of the user.

One or more embodiments of an earbud described herein can provide a dual function of an open design earbud and an occluded design earbud. For example, FIGS. 4-5 are schematic views of the earbud 10 inserted into an ear canal 90 of a user. FIG. 4 is a schematic cross-section view of a portion of the earbud 10 after it has been inserted into the ear canal 90. The earbud 10 is in a first position, where the first flange 40 has been inserted into the ear canal 90 through an opening 94 of the canal. When in this first position, ambient sound can enter the ear canal 90 through the vents 50 of the first flange 40 and be received by the user. In the first position, the second flange 60 does not occlude the ear canal 90; therefore, the second flange does not form an acoustic seal against sidewalls 92 of the ear canal 90. The first flange 40 engages the sidewalls 92 of the canal 90 and at least in part retains the earbud 10 within the ear canal 90. In one or more embodiments, a maximum circumference of the first flange 40 is greater than a maximum circumference of at least a portion of the ear canal 90 such that the first flange 40 can engage the sidewalls 92 and retain the earbud within the ear canal.

To substantially or completely eliminate ambient sound, the user can reposition or manipulate the earbud 10 to a second position, which is schematically shown in FIG. 5. In the second position, the second flange 60 has been inserted into the ear canal 90 through opening 94 such that the second flange engages the sidewalls 92 of the canal. In the second position, the second flange 60 can form an acoustic seal against the sidewalls 92 of the ear canal 90. This can result in a sealed cavity or enclosure within the ear canal between the second flange 60 and the eardrum (not shown). Such sealed cavity can, in one or more embodiments, improve a base response of an audio signal directed into the canal 90 by a hearing device acoustically connected to the earbud 10. Further, the earbud 10 when in the second position can substantially or completely block or occlude ambient sound from reaching the eardrum of the user. In one or more embodiments, the second flange 60 at least partially occludes the ear canal 90 when the earbud is in the second position. In one or more embodiments, the second flange 60 completely occludes the ear canal 90 when the earbud is in the second position.

The user can return the earbud 10 to the first position as shown in FIG. 4 by manipulating the earbud and withdrawing it from the ear canal 90. The resilient ring 46 of the first flange 40 can, in one or more embodiments, prevent the first flange from crinkling or folding as the earbud 10 is being withdrawn from the ear canal 90 and returned to the first position. After being manipulated back to the first position, the earbud 10 can be retained within the ear canal 90 as shown in FIG. 4, and ambient sound can be provided to the user through vents 50. Further, the user can completely remove the earbud 10 from the ear canal 90 by further manipulating the earbud away from the opening 94 of the ear canal.

Figure 6:
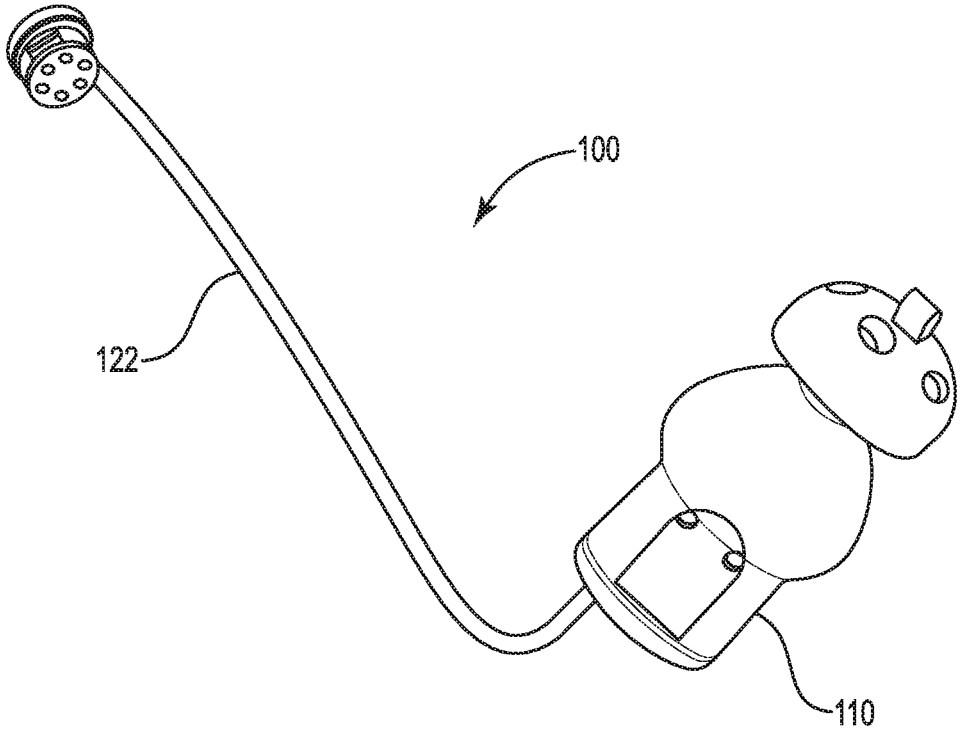
FIG. 6 is a schematic perspective view of one embodiment of a hearing device that includes the earbud of FIG. 1.
Figure 7:
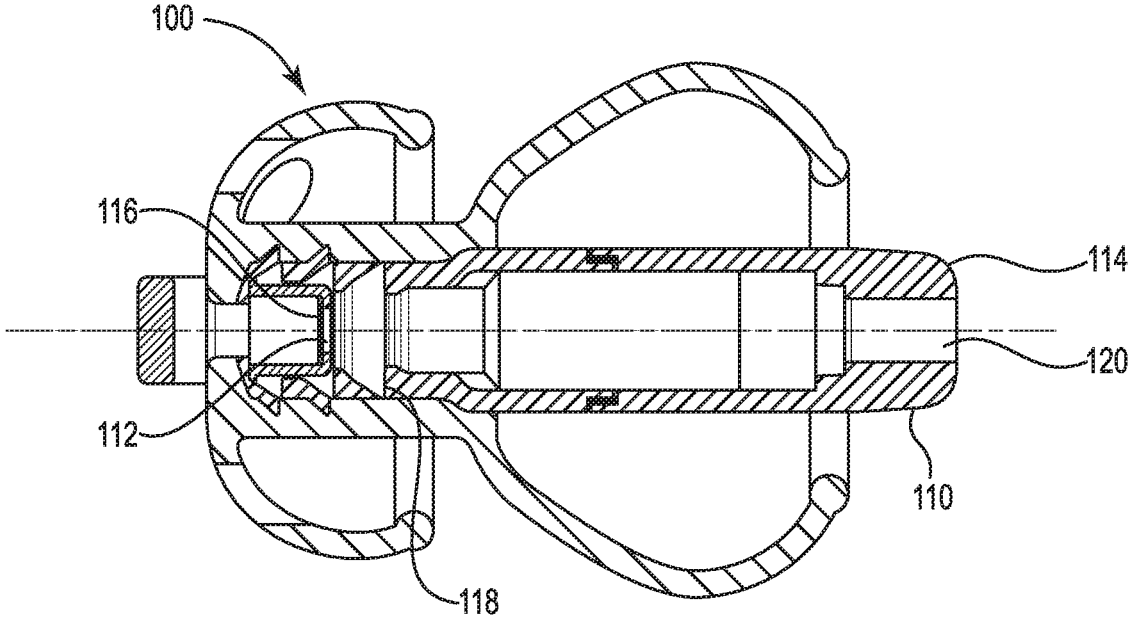
FIG. 7 is a schematic cross-section view of a portion of the hearing device of FIG. 6.

As mentioned herein, the various embodiments of earbuds can be utilized with any suitable hearing device. For example, FIGS. 6-7 are schematic views of one embodiment of a hearing device 100. Hearing device 100 can include any suitable hearing device such as a personal audio device (e.g., smart phone, radio, etc.) or hearing assistance device such as in-the-ear (ITE), in-the-canal (ITC), receiver-in-canal (RIC), or completely-in-the-canal (CIC) type hearing aids. Although depicted as including the earbud 10 of FIGS. 1-5, the hearing device 100 of FIGS. 6-7 can be utilized with any embodiment of earbud described herein.

The hearing device 100 includes a housing 110 and the earbud 10 connected to the housing. The housing 110 includes a first end 112 and a second end 114. The housing 110 also includes a sound port 116 disposed at its first end 112. The housing 110 also includes a retainer ring 118 also disposed at the first end 112 of the housing. The retainer ring 118 is adapted to engage one or more of the ribs 28 that are disposed within the body 20 of the earbud 10 to retain the housing 110 within the cavity 26 of the body.

Any suitable technique or techniques can be utilized to connect the housing 110 with the earbud 10. In the embodiment illustrated in FIGS. 6-7, the housing 110 is inserted into the earbud 10 by manipulating the housing into the cavity 72 of the second flange 60 and the cavity 26 of the first flange, where the housing is retained by the retainer ring 118 of the housing and the rib or ribs 28 of the body 10. In one or more embodiments, an adhesive can be used to connect the housing 110 to the earbud 10 without the need for the retainer ring 118 and the ribs 28. In one or more embodiments, the earbud 10 can be insert molded onto the housing 110.

The hearing device 100 can include one or more hearing assistance components (not shown) disposed within the housing 110. Any suitable hearing assistance component or components can be disposed within the housing, e.g., battery, circuit module, receiver (i.e., speaker), microphone, antenna, telecoil, near-field magnetic induction coil, etc. In one or more embodiments, one or more speakers can be disposed within the housing to provide an acoustic signal to the user that includes various frequency ranges. For example, in one or more embodiments, both a woofer and a twitter can be disposed within the housing 110 to provide high and low frequency acoustic signals to the user.

Further, the housing 110 can include a sound port 120 that can be acoustically connected to one or more additional hearing assistance components (not shown) by sound tube 122. In one or more embodiments, the earbud 10 can be acoustically connected to one or more electronic components by wired electrical connection, or wireless connections such as Bluetooth, near field communication, etc. Further, in one or more embodiments, the earbud can be directly connected to a hearing device or hearing assistance device without providing one or more hearing assistance components within the housing 110. For example, in one or more embodiments, the sound tube 122 can be directly inserted into the cavity 72 of the second flange and the cavity 26 of the first flange 40 without the housing 110 being disposed within the earbud.

Figure 8:
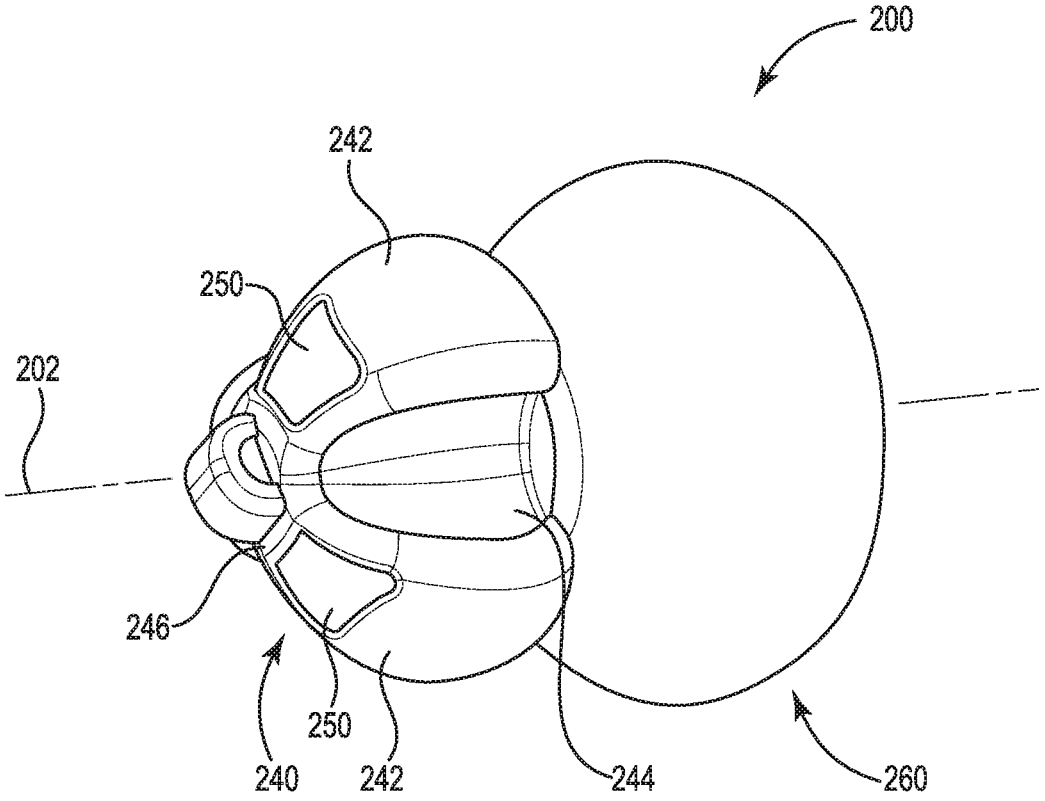
FIG. 8 is a schematic perspective view of another embodiment of an earbud.

As mentioned herein, the earbud can take any suitable shape or shapes. For example, FIG. 8 is a schematic perspective view of another embodiment of an earbud 200. All of the design considerations and possibilities regarding the earbud 10 of FIGS. 1-5 apply equally to the earbud 200 of FIG. 8. The earbud 200 includes a first flange 240 and a second flange 260. One or more vents 250 can be disposed through the first flange 240.

One difference between the earbud 200 and earbud 10 is that the first flange 240 includes three lobes 242 each separated by a notch 244 that extends between a first end 246 and a second end 248 of the first flange. Although depicted as including three lobes 242, the first flange 240 can include any suitable number of lobes, e.g., 1, 2, 3, 4, 5 or more lobes.

Each lobe 242 can take any suitable shape or shapes and have any suitable dimensions. Further, each notch 244 can also take any suitable shape or shapes and have any suitable dimensions. In one or more embodiments, the lobes 242 may allow a portion or portions of the first flange 240 to collapse towards the body axis 202 when the first flange is inserted into an ear canal (e.g., ear canal 90 of FIGS. 4-5).

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. An earbud for insertion into an ear canal, comprising:

an elongated body comprising a first end, a second end, and a cavity that extends along a body axis between the first end and the second end of the elongated body;

a first flange connected to the elongated body and comprising a first end adjacent the first end of the elongated body, a second end, and a sound hole disposed in the first end of the first flange that is acoustically connected to the cavity of the elongated body, wherein the first flange further comprises an open vent disposed through the first flange;

and a second flange connected to the second end of the elongated body and comprising a first end adjacent the second end of the elongated body and a second end, wherein the second flange does not include a vent.

2. The earbud of claim 1, wherein the first flange and the second flange are integral with the elongated body.

3. The earbud of claim 1, further comprising a wax bridge disposed on an outer surface of the first flange along the body axis and over the sound hole.

4. The earbud of claim 1, wherein at least a portion of the first flange is adapted to collapse towards the body axis when the first flange is inserted into the ear canal.

5. The earbud of claim 1, wherein at least a portion of the second flange is adapted to collapse towards the body axis when the second flange is inserted into the ear canal.

6. The earbud of claim 1, wherein the first flange has a maximum circumference measured in a plane orthogonal to the body axis, and the second flange has a maximum circumference measured in the plane orthogonal to the body axis, wherein the maximum circumference of the first flange is less than the maximum circumference of the second flange.

7. The earbud of claim 1, wherein the elongated body is adapted to be connected to a sound tube of a hearing assistance device.

8. The earbud of claim 1, wherein a circumference of the first flange measured in a plane orthogonal to the body axis increases in a direction from the first end to the second end of the first flange.

9. The earbud of claim 1, wherein a circumference of the second flange measured in a plane orthogonal to the body axis increases in a direction from the first end to the second end of the second flange.

10. The earbud of claim 1, wherein the second end of the first flange comprises a retainer ring.

11. The earbud of claim 1, wherein the second end of the second flange comprises a retainer ring.

12. The earbud of claim 1, wherein at least one of the first and second flanges comprises a resilient material.

13. The earbud of claim 1, wherein at least one of the first and second flanges comprises an elliptical circumference in a plane orthogonal to the body axis.

14. The earbud of claim 1, wherein the first flange comprises two lobes separated by a notch that extends between the first end and a second end of the first flange.

15. The earbud of claim 14, wherein the vent is disposed through a lobe of the two lobes.

16. A hearing device, comprising:

a housing comprising a sound port;

hearing assistance components disposed within the housing;

an earbud connected to the housing and adapted to be inserted into an ear canal, wherein the earbud comprises:

an elongated body comprising a first end, a second end, and a cavity that extends along a body axis between the first end and the second end of the elongated body, wherein the cavity is acoustically connected to the sound port of the housing;

a first flange connected to the elongated body and comprising a first end adjacent the first end of the elongated body, a second end, and a sound hole disposed in the first end of the first flange that is acoustically connected to the cavity of the elongated body, wherein the first flange further comprises an open vent disposed through the first flange; and a second flange connected to the second end of the elongated body and comprising a first end adjacent the second end of the elongated body and a second end, wherein the second flange does not include a vent.

17. The device of claim 16, wherein the housing is inserted into the cavity of the elongated body of the earbud.

18. The device of claim 16, further comprising a sound tube acoustically connected to the cavity of the elongated body of the earbud and the sound port of the housing.

19. The device of claim 16, wherein the first flange includes first, second, and third lobes each separated by a notch that extends between the first end and the second end of the first flange.

20. The device of claim 19, wherein when the vent is disposed through the first lobe, a second vent is disposed through the second lobe, and a third vent is disposed through the third lobe.

* * * * *